US007349799B2

(12) United States Patent
Joe et al.

(10) Patent No.: US 7,349,799 B2
(45) Date of Patent: Mar. 25, 2008

(54) APPARATUS AND METHOD FOR PROCESSING TRAFFIC INFORMATION

(75) Inventors: Moon Jeung Joe, Anyang-si (KR); Mun Ho Jung, Seongnam-si (KR); Yong Hyun Park, Yongin-si (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 11/109,233

(22) Filed: Apr. 18, 2005

(65) Prior Publication Data

US 2005/0187708 A1 Aug. 25, 2005

(30) Foreign Application Priority Data

Apr. 23, 2004 (KR) ..... 10-2004-0028382
Apr. 23, 2004 (KR) ..... 10-2004-0028384
Apr. 23, 2004 (KR) ..... 10-2004-0028385

(51) Int. Cl.
*H04H 1/00* (2006.01)
*G08G 1/0968* (2006.01)

(52) U.S. Cl. ..... 701/117; 701/211; 340/995.13

(58) Field of Classification Search ..... None
See application file for complete search history.

(56) References Cited

U.S. PATENT DOCUMENTS 6,438,561 B1 * 8/2002 Israni et al. ..... 707/104.1
6,574,555 B2 * 6/2003 Mochizuki et al. ..... 701/211
6,996,089 B1 * 2/2006 Ruf et al. ..... 370/349
2003/0083813 A1 * 5/2003 Park ..... 701/210

FOREIGN PATENT DOCUMENTS

JP 11-258981 * 9/1999

* cited by examiner

*Primary Examiner*—Michael J. Zanelli
(74) *Attorney, Agent, or Firm*—Lee, Hong, Degerman, Kang & Schmadeka

(57) ABSTRACT

In the present invention, traffic information broadcast by a traffic information center is received, indexes are created, and the index and travel speed information on a mobile object are stored. A matching table is created to match first map data for use in broadcasting the traffic information and second map data used by a navigation system to each other. The traffic information is simply matched to the second map data used by the navigation system, using the created matching table. When the travel speed of the mobile object on each link is intended to be displayed with a predetermined color after the matching of the traffic information to the second map data, the storage capacity of a traffic information storage unit is reduced, which stores traffic information displayed together with arrows for indicating the travel direction.

24 Claims, 10 Drawing Sheets

<FIG.1>
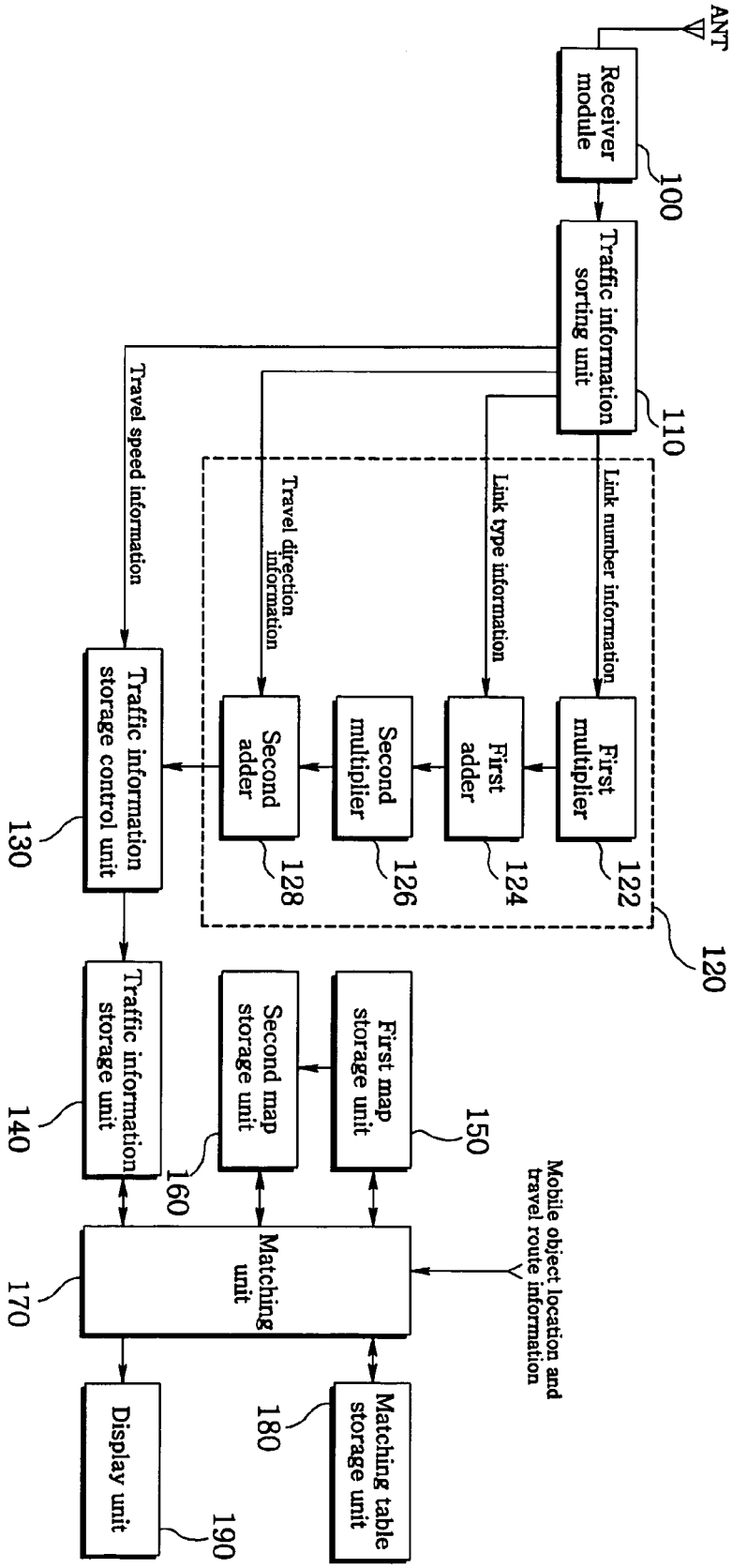

<FIG. 2>
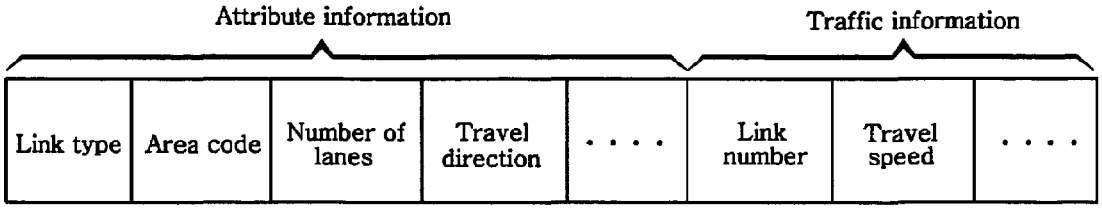
<FIG. 3>
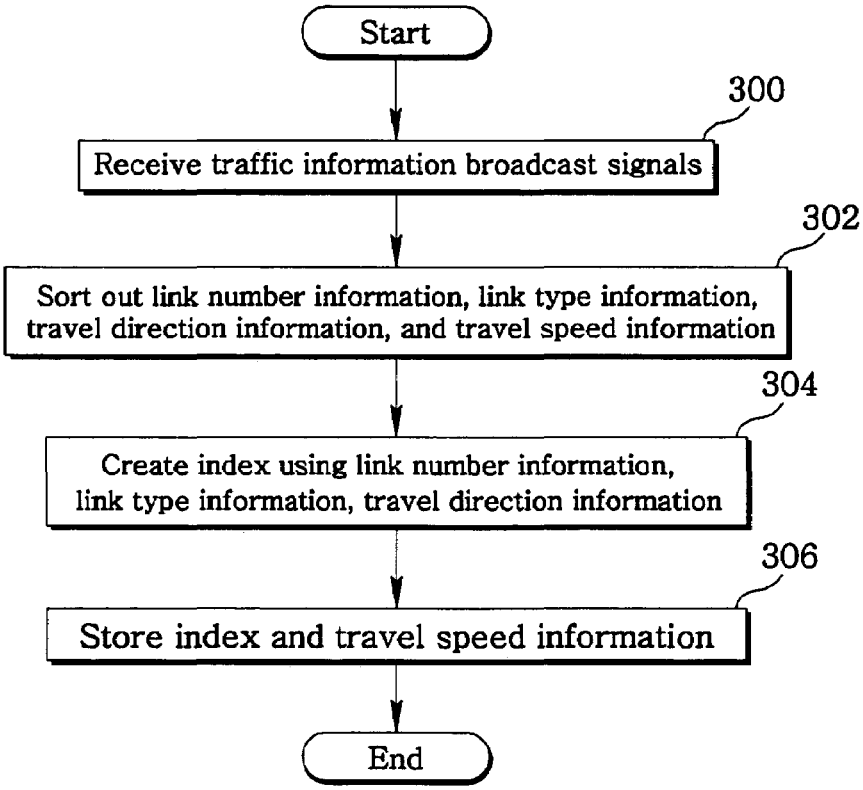

<FIG. 4>
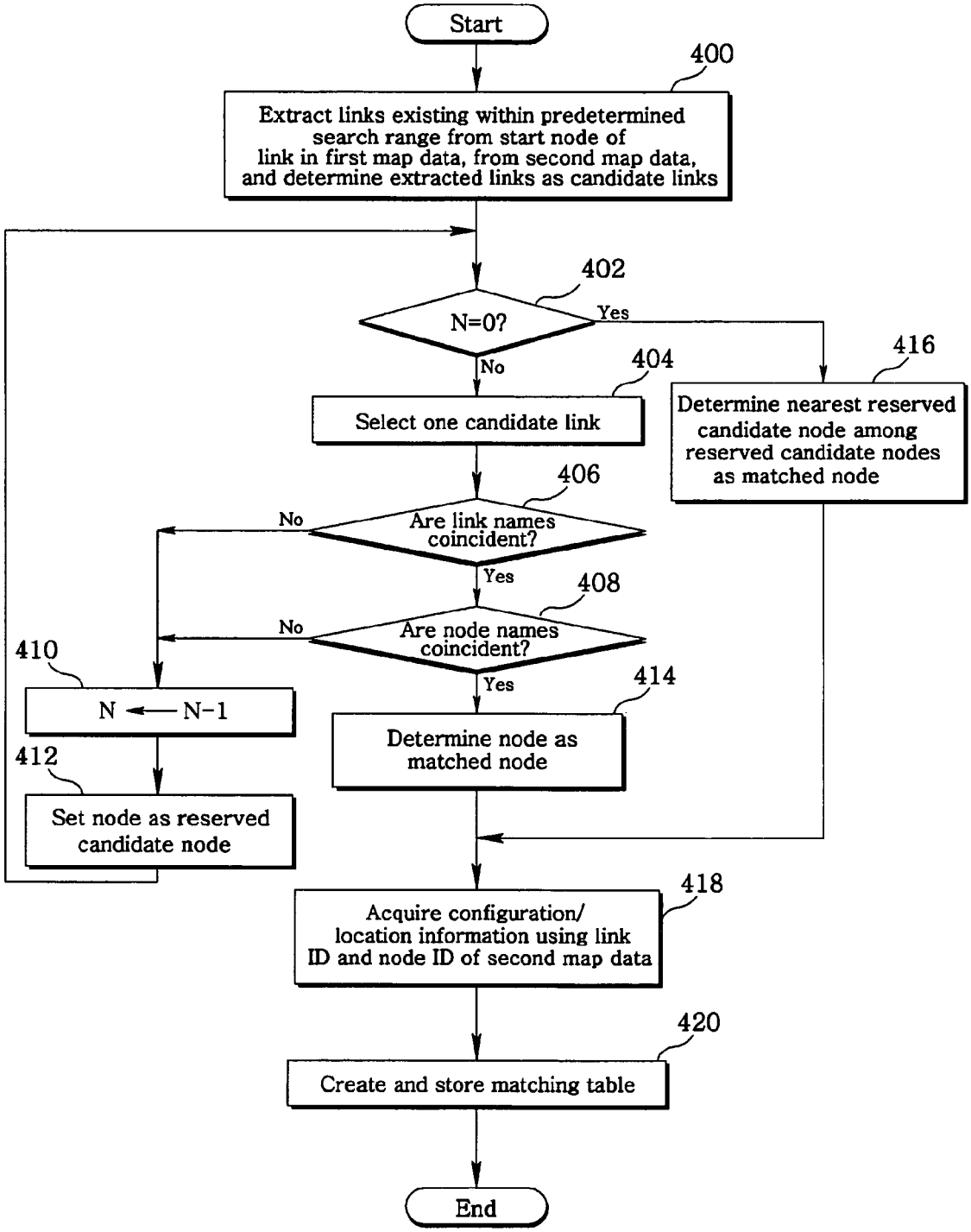

<FIG. 5a>

| First map | | | |
|---|---|---|---|
| Link ID | | | |
| Link name | | | |
| Start node ID | | End node ID | |
| Start node name | | End node name | |
| Lon | Lat | Lon | Lat |

<FIG. 5b>

| Second map | | | |
|---|---|---|---|
| Link ID | | | |
| Link name | | | |
| Start node ID | | End node ID | |
| Start node name | | End node name | |
| Lon | Lat | Lon | Lat |

<FIG. 5c>

| Matching table | | | |
|---|---|---|---|
| Link ID of first map data | | | |
| Link ID of second map data | | | |
| Start node ID | | End node ID | |
| First configuration | | $N^{th}$ configuration | |
| Lon | Lat | Lon | Lat |
| Second configuration | | $N-1^{th}$ configuration | |
| Lon | Lat | Lon | Lat |
| ⋮ | | | |

<FIG. 6>
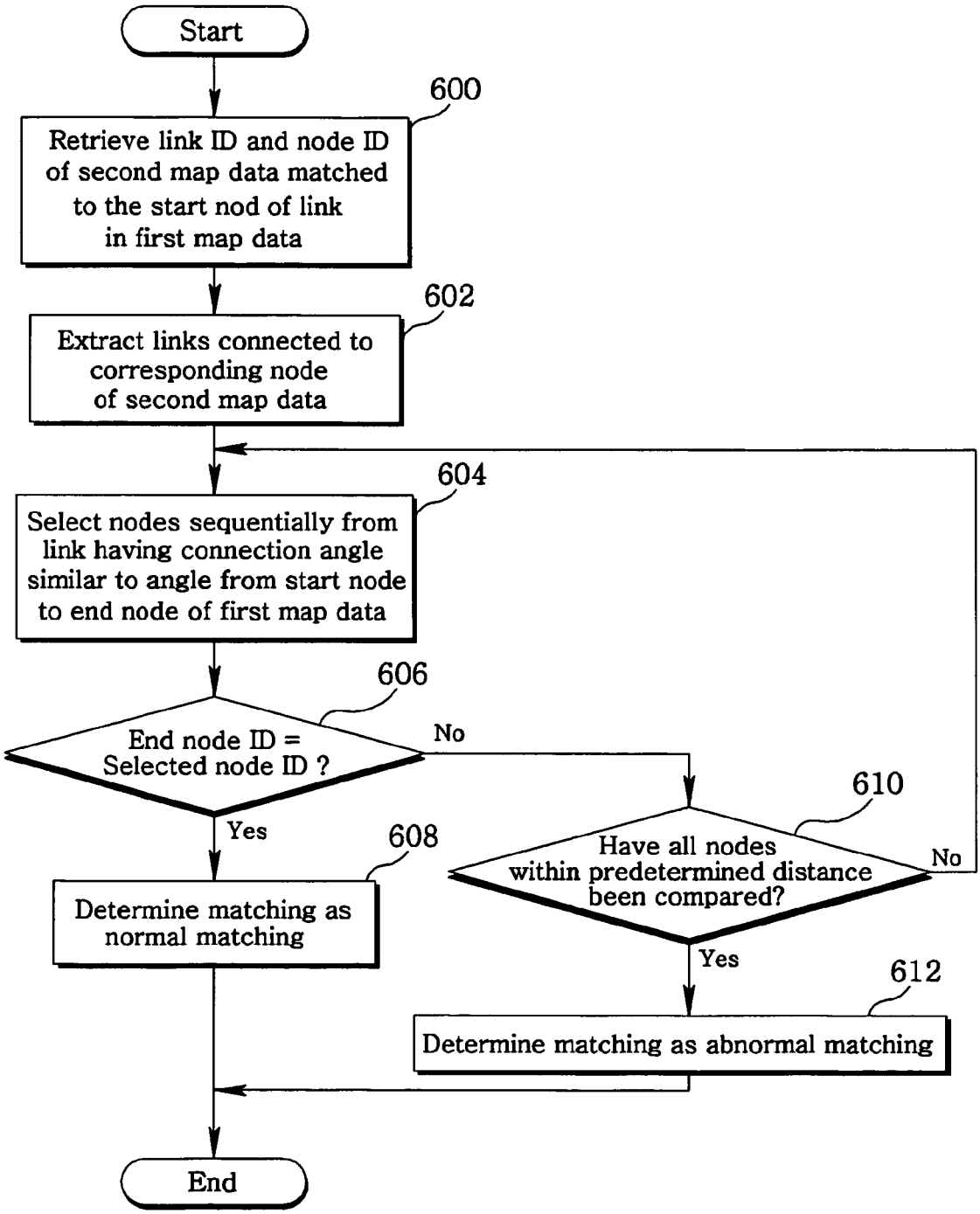

<FIG. 7>
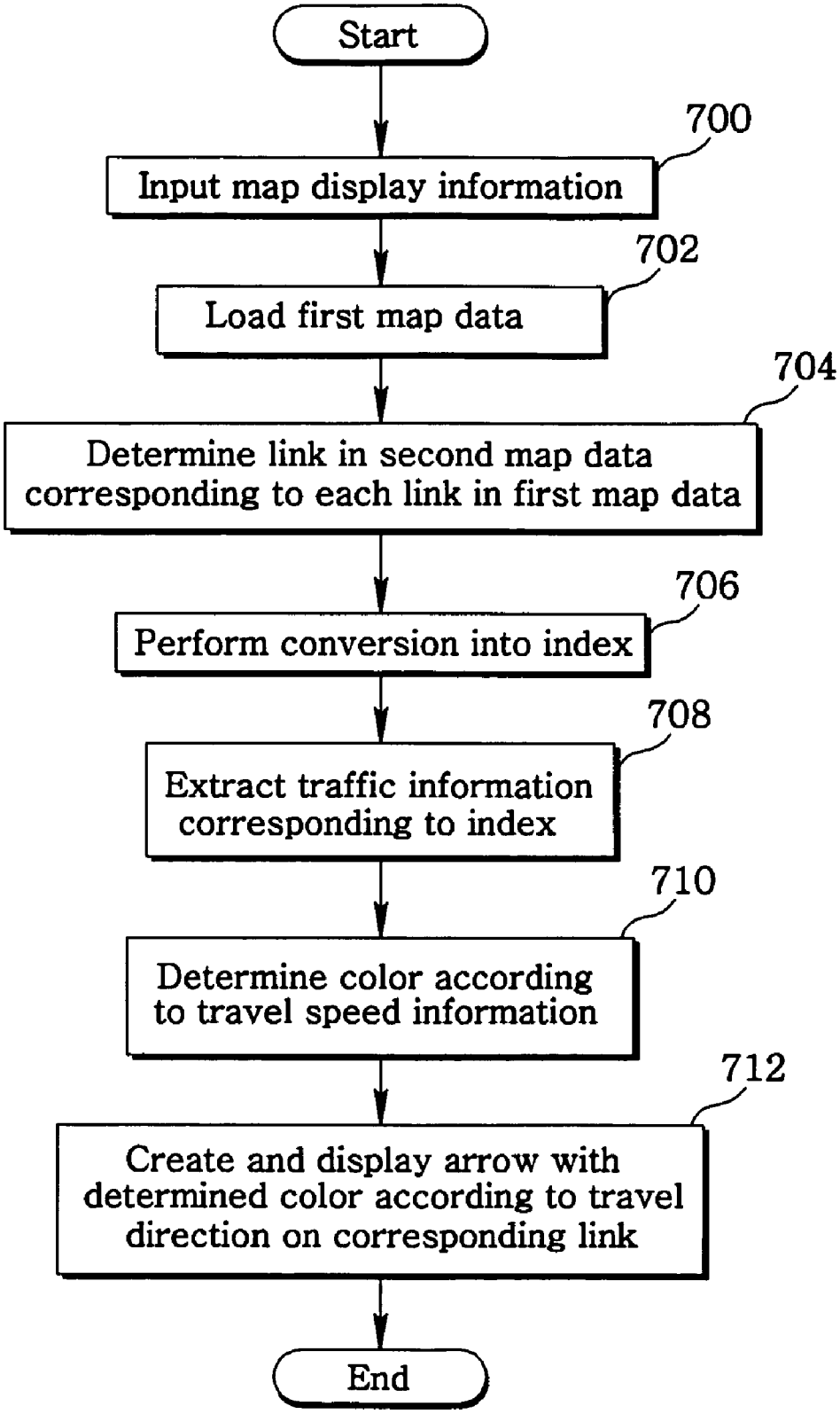

<FIG. 8>
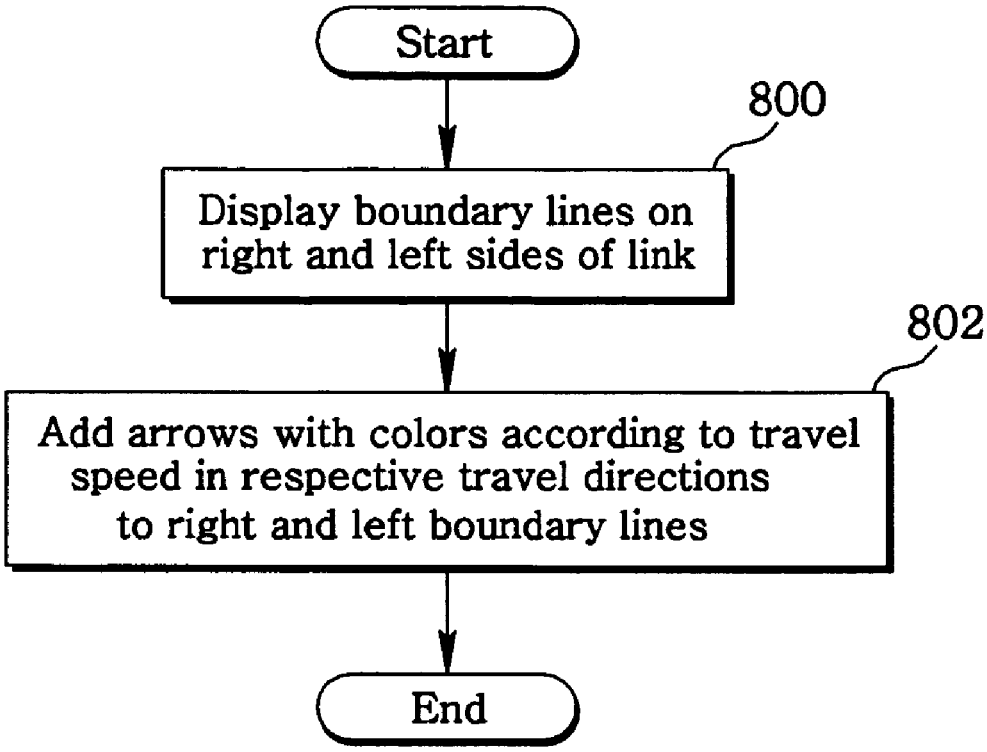
<FIG. 9>
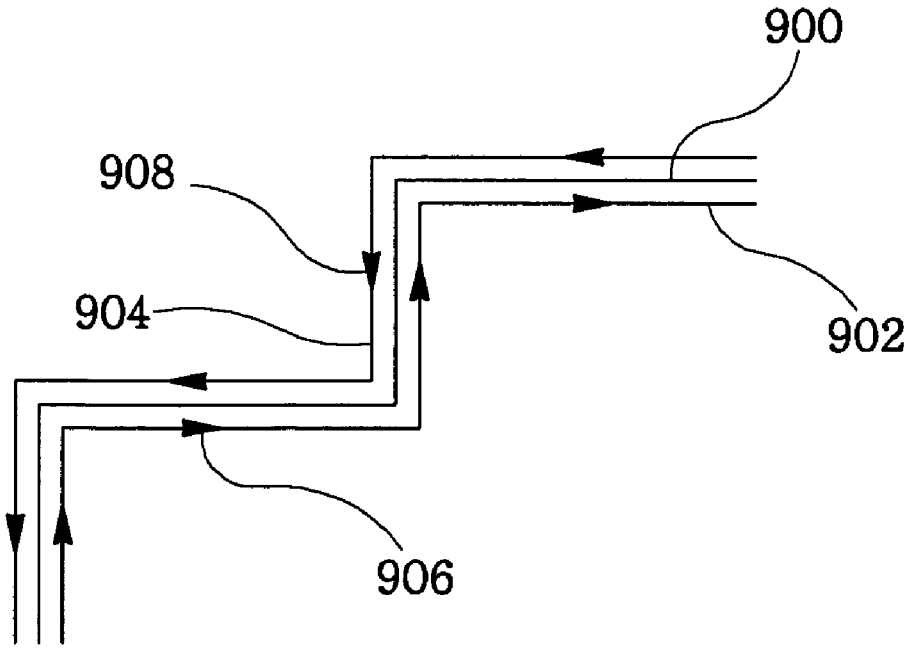

<FIG. 10>
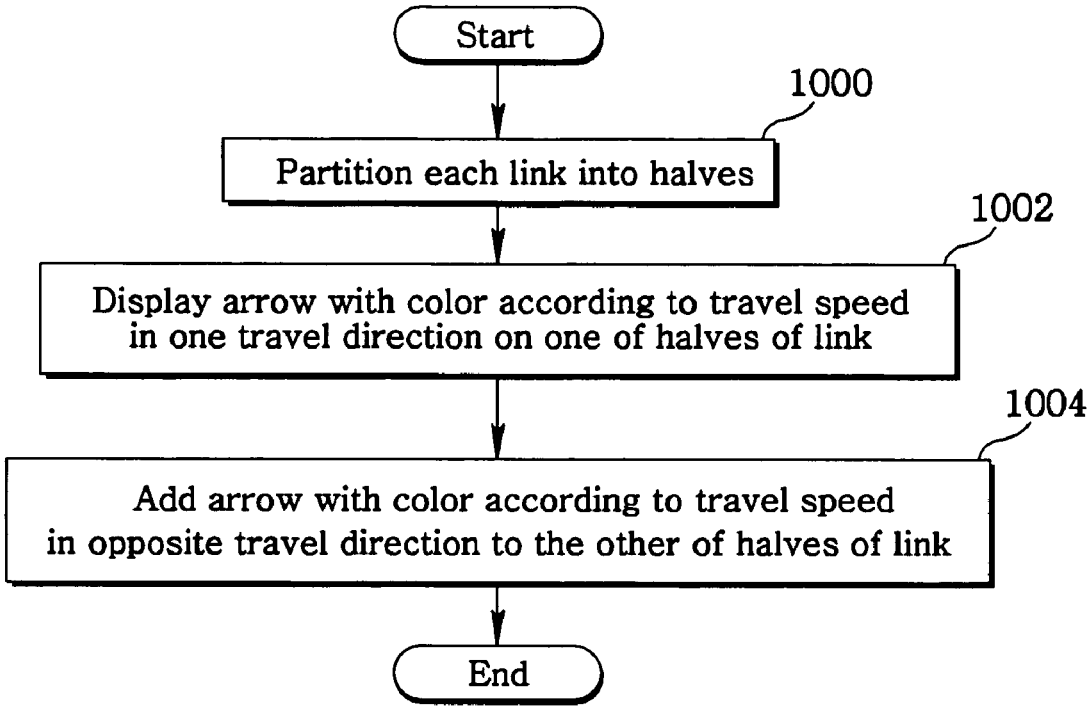
<FIG. 11>
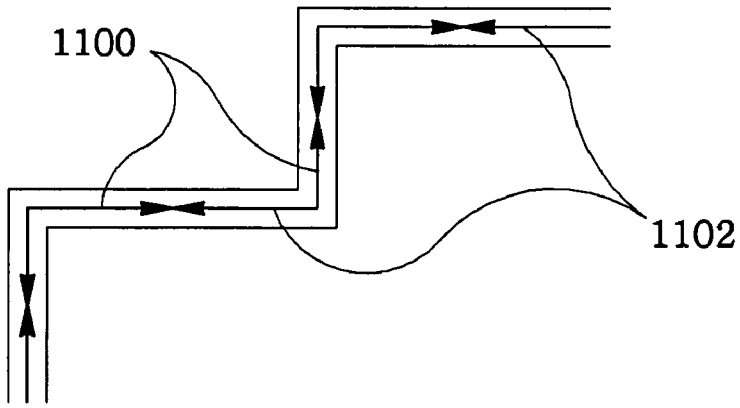

<FIG. 12>
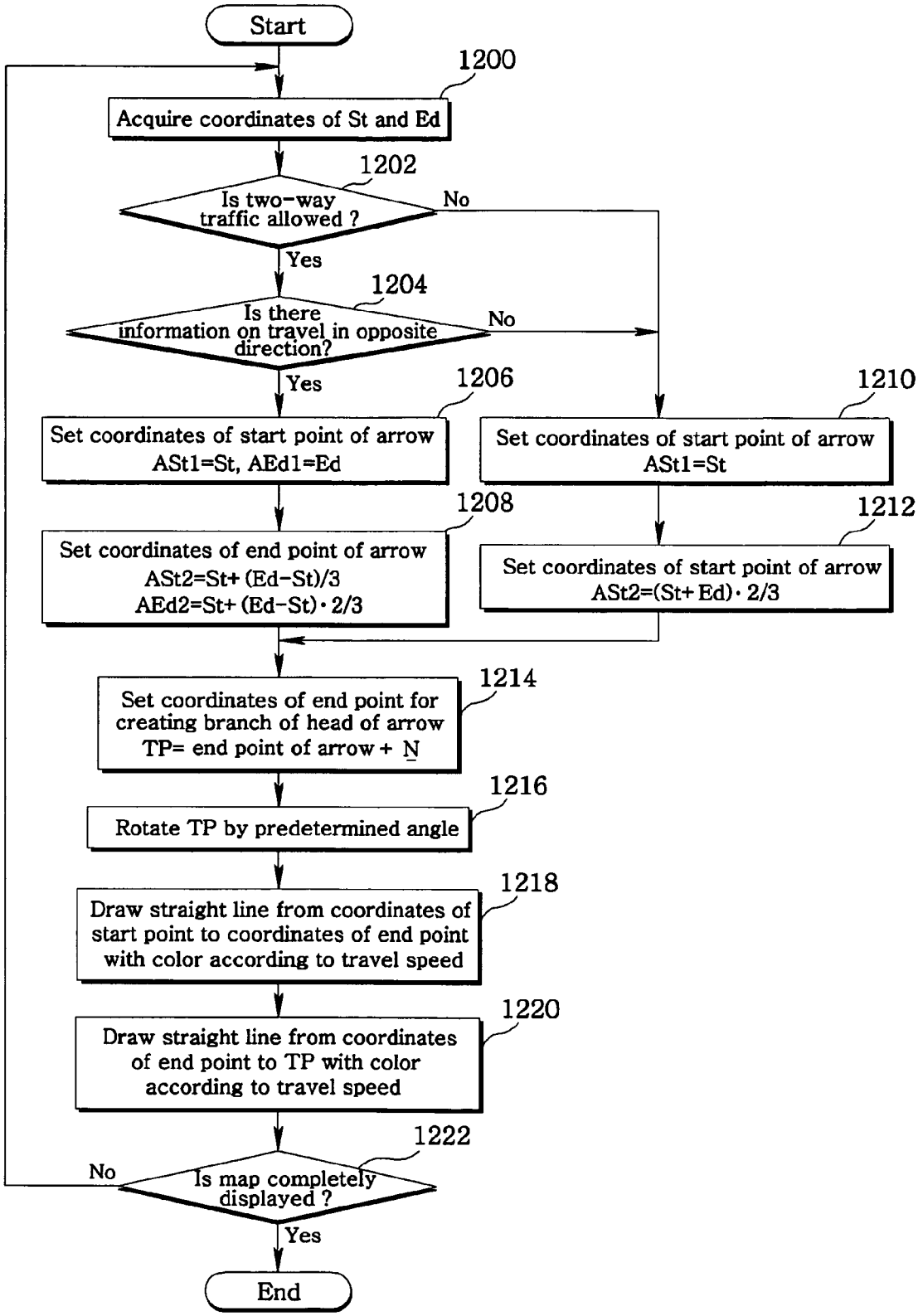

<FIG. 13a>
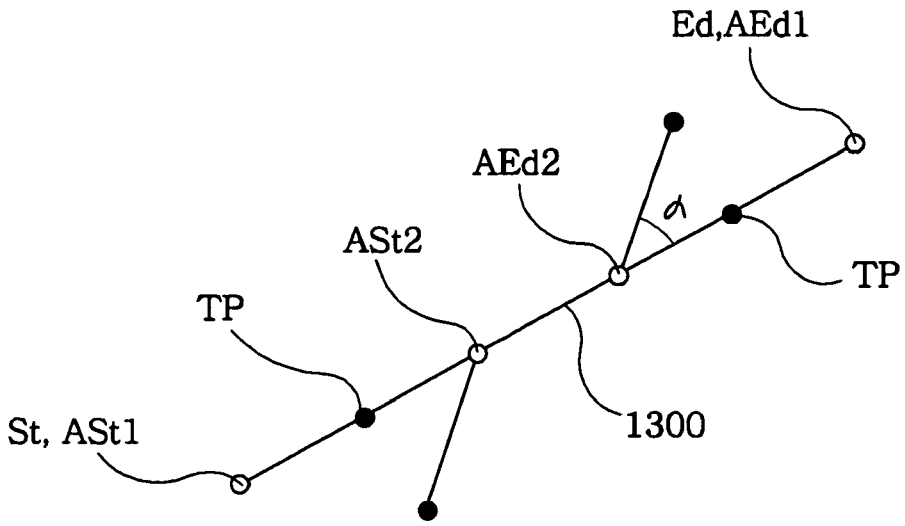
<FIG. 13b>
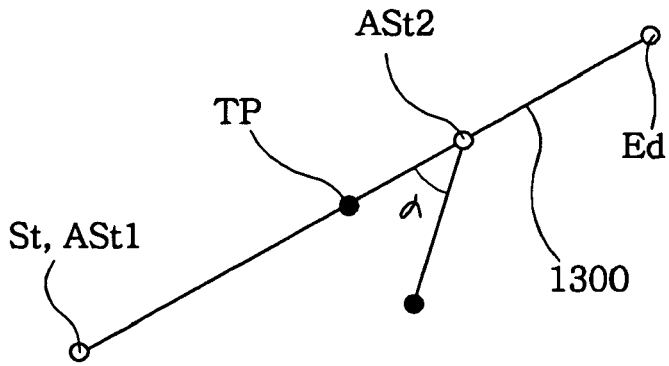
<FIG. 14>
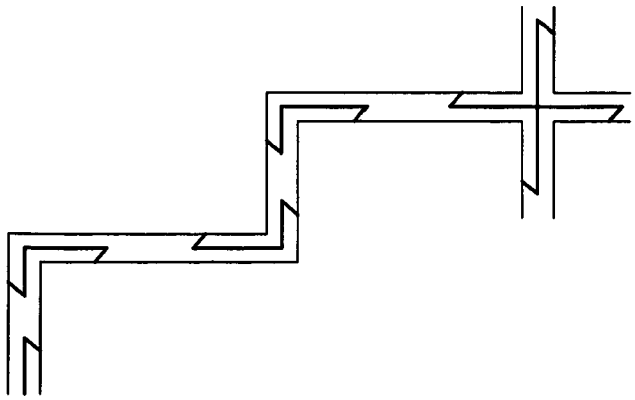

APPARATUS AND METHOD FOR PROCESSING TRAFFIC INFORMATION

CROSS-REFERENCE TO RELATED APPLICATIONS

Pursuant to 35 U.S.C. §119(a), this application claims the benefit of earlier filing date and right of priority to Korean Application No. 33421/2001, filed on Jun. 14, 2001, the contents of which are hereby incorporated by reference herein in their entirety.

BACKGROUND OF THE INVENTION

1. Field of the Invention

The present invention relates to a navigation system which displays the current location of a mobile object on a map and guides the travel route of the mobile object, and more particularly, to an apparatus and method for processing traffic information, wherein a navigation system receives and processes real-time traffic information that is collected through various channels and is broadcast as an FM multiplex broadcast by a traffic information center.

2. Description of the Related Art

With the continuous increase of various kinds of mobile objects including vehicles, traffic congestion has become serious. Specifically, there is a serious problem in that the increase of mobile objects has overtaken the rate of expansion of roads. A navigation system draws attention as one solution to traffic congestion. A navigation system receives navigation messages transmitted by GPS (Global Positioning System) satellites, detects the current location of a mobile object, matches the current location of the mobile object to map data, and displays the current location of the mobile object together with a map on a display unit.

Therefore, a user of a mobile object can check the current location of the mobile object and the shortest route from the current location to a destination. In addition, the user can efficiently utilize a given road network by scheduling a travel route from the current location of the mobile object to the destination according to guidance from the navigation system, and by causing the mobile object to travel along the scheduled travel route.

Meanwhile, a traffic information center collects traffic information on respective roads in real-time through various channels, and broadcasts the collected real-time traffic information via an FM multiplex broadcast.

Therefore, a manufacturer of a navigation system provides a user of a mobile object with traffic information on roads around the current location of the mobile object, through the navigation system which receives real-time traffic information broadcast by a traffic information center via the FM multiplex broadcast, displays on a display panel the received traffic information together with a map of roads where the mobile object will travel. In addition, when searching for a travel route from the current location of a mobile object to a destination, a navigation system searches for an optimal route along which the mobile object can travel to the destination in the shortest period of time, with reference to the received traffic information.

When the navigation system receives and processes the traffic information via the FM multiplex broadcast, according to a conventional scheme, all the traffic information sorted by a traffic information sorting unit is stored in a traffic information storage unit and then displayed on a display unit after the stored traffic information is matched to map data by a matching unit.

Therefore, the storage capacity of the traffic information storage unit in which traffic information is stored has to be so large as to store the traffic information broadcast by the traffic information center. In addition, the matching unit compares every road displayed on a map with the traffic information stored in the traffic information storage unit, retrieves the traffic information relevant to each road, matches the retrieved traffic information to the map, and displays the information on a display unit. Therefore, the matching unit has a large amount of calculation and needs a great deal of time, so that traffic information is very difficult to display in real-time.

In addition, in order to match the traffic information broadcast by the traffic information center to each road on a map and display the information thereon, a coordinate system for map data used by the traffic information center for broadcasting the traffic information has to be identical with that for map data used by a navigation system. However, the traffic information center broadcasts the traffic information using DARC (Data Radio Channel) map data, while the navigation system uses different map data provided by each manufacturer thereof, causing problems in that the traffic information broadcast by the traffic information center cannot be matched directly to the map data used by the navigation system.

Therefore, in the navigation system, the map data for use in broadcasting the traffic information by the traffic information center have to be matched to the map data used by the navigation system, and, using the matching information of the map data, the traffic information has to be matched to the map data used by the navigation system.

In addition, when a conventional navigation system retrieves the travel speed of a mobile object on each road from the received traffic information, matches it to map data, and displays it on a display unit, the color of a road is displayed in accordance with the travel speed of the mobile object but the direction of the displayed travel speed is not displayed. Therefore, there is a problem in that a user of the navigation system cannot identify which travel direction a travel speed on a relevant road corresponds to, based on the displayed color of the road. That is, since roads generally allow two-way traffic, there is a problem in that it is impossible to determine whether the travel speed displayed with a predetermined color is in a forward direction or in an opposite direction on the corresponding road.

SUMMARY OF THE INVENTION

Therefore, it is a first object of the present invention to provide an apparatus and method for processing traffic information, wherein the storage capacity of a traffic information storage unit can be reduced in a navigation system that receives traffic information broadcast by a traffic information center and stores the information in the traffic information storage unit.

It is a second object of the present invention to provide an apparatus and method for processing traffic information, wherein a matching table, which can match map data used for broadcasting traffic information by a traffic information center to map data used by a navigation system, is created, and the traffic information can be matched easily to the map data used by the navigation system using the created matching table.

Therefore, it is a third object of the present invention to provide an apparatus and method for processing traffic information, wherein when the travel speed of a mobile object on each road is displayed with a predetermined color according to traffic information, a travel direction is displayed together therewith, thereby allowing a user to easily check both the travel speed and direction.

According to a first aspect of the present invention for achieving the objects, there is provided an apparatus for processing traffic information, comprising a receiver module for receiving the traffic information; a traffic information sorting unit for analyzing the traffic information received by the receiver module and sorting the analyzed traffic information according to information type; an index creation unit for creating a unique index according to a link and a travel direction, using remaining traffic information except travel speed information among the traffic information sorted by the traffic information sorting unit; a traffic information storage control unit for controlling storage of the index created by the index creation unit and the travel speed information sorted by the traffic information sorting unit; and a traffic information storage unit for storing the indexes and the travel speed information under the control of the traffic information storage control unit.

According to a second aspect of the present invention, there is provided an apparatus for processing traffic information, comprising a receiver module for receiving the traffic information; a traffic information sorting unit for analyzing the traffic information received by the receiver module and sorting the analyzed traffic information according to information type; an index creation unit for creating a unique index according to a link and a travel direction, using remaining traffic information except travel speed information among the traffic information sorted by the traffic information sorting unit; a traffic information storage control unit for controlling storage of the index created by the index creation unit and the travel speed information sorted by the traffic information sorting unit; a traffic information storage unit for storing the index and the travel speed information under the control of the traffic information storage control unit; a first map storage unit for storing first map data to be used by a traffic information center for broadcasting the traffic information; a second map storage unit for storing second map data to be used by a navigation system for guiding the travel of a mobile object; a matching unit for controlling extraction of a matching table for matching the first and second map data respectively stored in the first and second map storage units to each other, and displaying the traffic information stored in the traffic information storage unit after matching the traffic information to the second map data using the matching table; a matching table storage unit for storing the matching table extracted by the matching unit; and a display unit for displaying the second map data and the traffic information under the control of the matching unit.

According to a third aspect of the present invention, there is provided an apparatus for processing traffic information, comprising a receiver module for receiving the traffic information; a traffic information sorting unit for analyzing the traffic information received by the receiver module and sorting the analyzed traffic information according to information type; an index creation unit for creating a unique index according to a link and travel direction, using remaining traffic information except travel speed information among the traffic information sorted by the traffic information sorting unit; a traffic information storage control unit for controlling storage of the index created by the index creation unit and the travel speed information sorted by the traffic information sorting unit; a traffic information storage unit for storing the indexes and the travel speed information under the control of the traffic information storage control unit; a map storage unit for storing map data used by a traffic information center for broadcasting the traffic information and by a navigation system for guiding the travel of a mobile object; a matching unit for controlling displaying the traffic information stored in the traffic information storage unit after matching the traffic information to the map data; and a display unit for displaying the map data and the traffic information under the control of the matching unit.

The index creation unit may comprise a first multiplier for multiplying link number information, which has been sorted by the traffic information sorting unit, by two; a first adder for adding road type information, which has been sorted by the traffic information sorting unit, to an output signal of the first multiplier; a second multiplier for multiplying an output signal of the first adder by two; and a second adder for adding travel direction information, which has been sorted by the traffic information sorting unit, to an output signal of the second multiplier.

According to a fourth aspect of the present invention, there is provided a method for processing traffic information, comprising the steps of receiving, by a receiver module, traffic information broadcast signals; sorting, by a traffic information sorting unit, the received traffic information broadcast signals according to information type; creating, by an index creation unit, an index by combining remaining traffic information except travel speed information among the sorted traffic information; and storing, by a traffic information storage control unit, travel speed information sorted out by the traffic information sorting unit in a traffic information storage unit, using the created index.

According to a fifth aspect of the present invention, there is provided a method for processing traffic information, comprising the steps of receiving, by a receiver module, traffic information broadcast signals; sorting, by a traffic information sorting unit, the received traffic information broadcast signals according to information type; creating, by an index creation unit, an index by combining remaining traffic information except travel speed information among the sorted traffic information; storing, by a traffic information storage control unit, travel speed information sorted out by the traffic information sorting unit in a traffic information storage unit, using the created index; extracting links, which exist within a predetermined search range around the position of a start node of each link in first map data for use in broadcasting the traffic information, from second map data used by a navigation system, and setting the extracted links as candidate links to be matched to the link in the first map data; extracting one node most similar to the attribute of the start node of the link in the first map data among start nodes or end nodes of the set candidate links, and determining the extracted node as a matched node for the start node of the link in the first map data; acquiring configuration/location information on the link in the first map data, using a link ID and a node ID of the determined, matched node in the second map data, creating a matching table, and storing the created matching table in a matching table memory; matching the traffic information stored in the traffic information storage unit to the second map data using the stored matching table; and displaying the matched second map data and traffic information on a display unit.

According to a sixth aspect of the present invention, there is provided a method for processing traffic information, comprising the steps of receiving, by a receiver module, traffic information broadcast signals; sorting, by a traffic information sorting unit, the received traffic information broadcast signals according to information type; creating, by an index creation unit, an index by combining remaining traffic information except travel speed information among the sorted traffic information; storing, by a traffic information storage control unit, travel speed information sorted out by the traffic information sorting unit in a traffic information storage unit, using the created index; matching the traffic information stored in the traffic information storage unit to map data; and displaying the matched map data and traffic information on a display unit.

Information sorted out by the traffic information sorting unit may comprise link type information for use in identifying an expressway or a general road; travel direction information for use in identifying whether the traffic information is related to travel in a forward direction or an opposite direction; link number information for notifying a link related to the traffic information; and travel speed information on a mobile object at a relevant link. The index creating step may comprise the step of creating an index by combining link type information, travel direction information, and link number information among information sorted out by the traffic information sorting unit.

The candidate link setting step may comprise the step of converting coordinate values of the first and second map data into coordinate values in an identical coordinate system, extracting, from the second map data, the links existing within the predetermined search range around the start node of each link in the first map data, and setting the extracted links as the candidate links. The step of converting the coordinate values of the first and second map data into the coordinate values in the identical coordinate system may comprise the step of converting the coordinate values of the first map data into coordinate values in a coordinate system of the second map data, converting the coordinate values of the second map data into coordinate values in a coordinate system of the first map data, or converting all the coordinate values of the first and second map data into coordinate values in a longitude and latitude coordinate system.

The step of determining the matched node may comprise the steps of selecting the candidate links one by one, and determining whether the name of each candidate link is coincident with the name of the link in the first map data and whether the name of a start node or an end node of the candidate link is coincident with the name of the start node of the link in the first map data; if it is determined that the names of both the link and node are coincident with those of the start node of the link in the first map data, determining the node with the coincident node name as the matched node for the start node of the link in the first map data; and if it is determined that there is no candidate link with identical link and node names, determining, among candidate nodes, a node nearest to the start node of the link in the first map data as a matched node.

After the step of determining the matched node, the method may further comprise the step of determining whether the matching for the matched node is normal matching or abnormal matching. The step of determining whether the matched node is normal matching or abnormal matching may comprise the steps of extracting a link ID and a node ID of the node in the second map data, which has been matched to the start node of the link in the first map data, and extracting links connected to the corresponding node in the second map data; selecting one link, which has a connection angle most similar to the angle from the start node to the end node of the link in the first map data, from the extracted links, and choosing nodes of the selected link sequentially to determine whether an ID of a chosen node is coincident with an ID of the end node of the link in the first map data; if it is determined that there is a node with a coincident ID, determining the matching as the normal matching; and if it is determined that there is no node with a coincident ID, determining the matching as the abnormal matching. The abnormal matching determining step may comprise the step of determining the matching as abnormal matching, if there is no node with a coincident ID within a distance twice as large as the distance from the start node to the end node of the link in the first map data.

The traffic information matching step may comprise the steps of searching for a link in the first map data, which is matched to each link in the second map data, using the matching table stored in the matching table storage unit, creating an index by combining link number information, link type information and travel direction information on the searched link in the first map data, searching the traffic information stored in the traffic information storage unit using the created index, and performing matching to the corresponding link of the second map data.

The traffic information displaying step may comprise the steps of setting road boundary lines on right and left sides of each link in the first map data, and adding traffic information on the travel of a mobile object in a forward or opposite direction to the set right and left boundaries using arrows with predetermined colors according to the travel speed of the mobile object. The boundary lines of the link may be set by using road width information and road boundary information included in the first map data, or by calculating boundary areas using the number of lanes.

The traffic information displaying step may comprise the step of partitioning each link into halves, adding traffic information to one of the halves of the partitioned link using an arrow with a predetermined color according to the travel speed at which a mobile object can travel in a forward direction, and adding traffic information to the other of the halves of the partitioned link using an arrow in a predetermined color according to the travel speed at which a mobile object can travel in an opposite direction.

The traffic information displaying step may comprise the steps of setting coordinates of a start point and end point of an arrow for indicating the traffic information at each link; setting coordinates of a position at a predetermined distance from the set coordinates of the end point of the arrow in a direction toward the coordinates of the start point of the arrow, as coordinates of an end point of a branch of the head of the arrow; rotating the set coordinates of the end point of the arrow branch by a predetermined angle; and adding the arrow by drawing straight lines, from the set coordinates of the start point of the arrow to the set coordinates of the end point of the arrow, and from the coordinates of the rotated end point of the arrow branch to the coordinates of the end point of the arrow, with predetermined colors according to the travel speed of the traffic information.

The step of setting the coordinates of the start point and end point of the arrow may comprise the steps of acquiring the coordinates of the start point and end point of the link; determining whether the link allows two-way traffic and whether traffic information on travel in an opposite direction is stored in the traffic information storage unit; if it is determined that the link allows two-way traffic and the traffic information on travel in the opposite direction is stored, setting the coordinates of the start point and end point of the link as coordinates of start points of two arrows, respectively, and setting coordinates of positions on the link at a predetermined distance from the set coordinates of the start points of the two arrows as coordinates of end points of the arrows, respectively; and if it is determined that the link does not allow two-way traffic or traffic information on travel in the opposite direction is not stored, setting the coordinates of the start point of the link as coordinates of a start point of an arrow, and setting coordinates of a position on the link at a predetermined distance from the coordinates of the start point of the arrow as coordinates of an end point of the arrow.

BRIEF DESCRIPTION OF THE DRAWINGS

The above and other objects, features and advantages of the present invention will become apparent from the following description of preferred embodiments given in conjunction with the accompanying drawings, in which:

FIG. 1 is a block diagram illustrating the configuration of an apparatus for processing traffic information according to the invention;

FIG. 2 illustrates information included in the traffic information broadcast via an FM multiplex broadcast by a traffic information center;

FIG. 3 is a flowchart illustrating the procedure of processing and storing traffic information in a method of processing traffic information according to the invention;

FIG. 4 is a flowchart illustrating the procedure of creating a matching table for matching first and second map data to each other in the method of processing traffic information according to the invention;

FIGS. 5*a* to 5*c* are diagrams illustrating the procedure of creating the matching table of the first and second map data in the method of processing traffic information according to the invention;

FIG. 6 is a flowchart illustrating the procedure of determining the matching status of the first and second map data matched according to the method of processing traffic information according to the present invention;

FIG. 7 is a flowchart illustrating the procedure of displaying traffic information in the method of processing traffic information according to the invention;

FIG. 8 is a flowchart illustrating the operation of a first embodiment in which arrows with predetermined colors are created along the travel direction of a mobile object and inserted into the first map data in FIG. 7;

FIG. 9 is a diagram illustrating the operation of inserting the arrows with the predetermined colors into the first map data in FIG. 8;

FIG. 10 is a flowchart illustrating the operation of a second embodiment in which arrows with predetermined colors are created along the travel direction of a mobile object and inserted into the first map data in FIG. 7;

FIG. 11 is a diagram illustrating the operation of inserting the arrows with the predetermined colors into the first map data in FIG. 10;

FIG. 12 is a flowchart illustrating the operation of a third embodiment in which arrows with predetermined colors are created along the travel direction of a mobile object and inserted into the first map data in FIG. 7;

FIGS. 13*a* and 13*b* are diagrams illustrating the operation of creating the arrows in FIG. 12; and FIG. 14 is an exemplary diagram showing a state where traffic information is indicated on each link in FIG. 12.

DETAILED DESCRIPTION OF THE INVENTION

Hereinafter, an apparatus and method for processing traffic information according to the present invention will be described in detail with reference to the accompanying drawings.

FIG. 1 is a block diagram illustrating the configuration of an apparatus for processing traffic information according to the invention. As shown in the figure, the apparatus comprises a receiver module 100 for receiving, through an antenna (ANT), traffic information broadcast signals that are collected in real-time and broadcast via an FM multiplex broadcast by a traffic information center; a traffic information sorting unit 110 for analyzing the traffic information received by the receiver module 100 and sorting the traffic information according to information type; an index creation unit 120 for creating indexes by combining link number information, link type information, and travel direction information among the traffic information sorted by the traffic information sorting unit 110; a traffic information storage control unit 130 for storing the indexes created by the index creation unit 120 and the travel speed information sorted out by the traffic information sorting unit 110 into a traffic information storage unit 140; a first map storage unit 150 in which first map data used by the traffic information center for broadcasting the traffic information are stored; a second map storage unit 160 in which second map data used by a navigation system for guiding the travel of a mobile object are stored; a matching unit 170 that controls extracting a matching table for matching the first and second map data stored in the first and second map storage units 150 and 160, respectively, to each other, and causing the traffic information stored in the traffic information storage unit to be matched to the second map data using the matching table and to be displayed together therewith; a matching table storage unit 180 for storing the matching table extracted by the matching unit 170; and a display unit 190 on which the second map data and the traffic information matched by the matching unit 170 are displayed.

The index creation unit 120 comprises a first multiplier 122 for multiplying the link number information, which has been sorted out by the traffic information sorting unit 110, by two; a first adder 124 for adding the road type information, which has been sorted out by the traffic information sorting unit 110, to an output signal of the first multiplier 122; a second multiplier 126 for multiplying an output signal of the first adder 124 by two; and a second adder 128 for adding the travel direction information, which has been sorted out by the traffic information sorting unit 110, to an output signal of the second multiplier 126.

In the apparatus for processing traffic information according to the present invention constructed as above, the traffic information center collects traffic information on each link in real-time, the collected real-time information is broadcast via the FM multiplex broadcast, the receiver module 100 receives the traffic information broadcast signals, which have been broadcast via the FM multiplex broadcast, through the antenna (ANT), and the traffic information sorting unit 110 sorts out the link number information, the link type information, the travel direction information and the travel speed information in the received traffic information.

That is, the traffic information includes attribute information and travel information, as illustrated in FIG. 2. The attribute information includes a variety of attribute information such as link type information for identifying whether a road is an expressway or a general road, region code information for notifying a region where a link exists, lane number information for notifying the number of lanes on a link, and travel direction information for notifying forward travel or opposite travel on a link. The travel information includes a variety of information on the travel of a mobile object, such as link number information for notifying a road related to the traffic information and speed information for notifying the travel speed on a relevant link.

In the traffic information configured as above, the traffic information sorting unit 110 sorts out the link type information, the travel direction information, and the travel speed information.

In the index creation unit 120, the first multiplier 122 multiplies the link type information, which has been sorted out by the traffic information sorting unit 110, by two; and the first adder 124 adds the link type information sorted out by the traffic information sorting unit 110 to the output signal of the first multiplier 122. Then, the second multiplier 126 multiplies the output signal of the first adder 124 by two; and the second adder 128 adds the travel direction information, which has been sorted out by the traffic information sorting unit 110, to the output signal of the second multiplier 126, thereby creating a unique index. That is, the index creation unit 120 creates an index using the link type information, the travel direction information, and the link number information from the following equation 1.

$$\text{Index}=\{(\text{link number information}\times 2)+\text{link type information}\}\times 2+\text{travel direction information} \quad (1)$$

The index created by the index creation unit 120 and the travel speed information sorted out by the traffic information sorting unit 110 are input into the traffic information storage control unit 130 that in turn stores the index and the travel speed information in the traffic information storage unit 140.

The first and second map data, which have different coordinate systems, are stored in the first and second map data storage units 150 and 160, respectively. For example, the first map data storage unit 150 stores DARC map data used by the traffic information center for broadcasting traffic information, and the second map data storage unit 160 stores map data used by the navigation system for guiding the current location and travel route of a mobile object.

The matching unit 170 extracts all candidate nodes, which exist within a predetermined search range around the position of a start node of a link in the first map data stored in the first map storage unit 150, from the second map data stored in the second map storage unit 160, and compares a link name and a node name with each other. If the link name and the node name are coincident with each other as a result of the comparison, a corresponding link and node are determined as a matched link and node. Then, a matching table is created by acquiring configuration/location information on the matched link, and the created matching table is stored in the matching table storage unit 180. In addition, after completion of the matching operation of all links and nodes in the first and second map data, IDs of the matched link and node are compared to determine whether it is normal matching or abnormal matching.

When the matching unit 170 intends to match the traffic information stored in the traffic information storage unit 140 to the second map data stored in the second map storage unit 160 and to display them on the display unit 190, the second map data stored in the second map storage unit 160 is retrieved first. Here, the retrieval of the second map data is performed, for example, by retrieving second map data on the current location of the mobile object or an area including the travel route of the mobile object.

Then, a link of the first map data matched to each link of the retrieved second map data is searched for using the matching table stored in the matching table storage unit 180, and an index is created by substituting link number information, link type information and travel direction information of the searched link of the first map data into Equation 1. When an index is created, travel speed information is retrieved from the traffic information storage unit 140 by searching for the same index as the created index. After the retrieval of the travel speed information, the matching unit 170 creates travel direction-indicating arrows with a color depending on the travel speed on the relevant link of the second map data, which corresponds to the travel speed information, and the created arrows are output to the display unit 190 and then displayed in a map.

Therefore, a user of a navigation system can check a travel speed according to the travel direction of a mobile object on each link by means of the arrows in the map displayed on the display unit 190.

FIG. 3 is a flowchart illustrating the procedure of processing and storing the traffic information in the method of processing traffic information according to the invention. As shown in the figure, the receiver module 100 receives traffic information broadcast signals through the antenna (ANT) (step 300), and the traffic information sorting unit 110 sorts out the link type information, the travel direction information and the travel speed information in the received traffic information broadcast signals (step 302).

The link type information, the travel direction information and the travel speed information, which have been output by the traffic information sorting unit 110, are combined according to Equation 1 so that the index creation unit 130 can create an index (step 304), and the created index and the traffic information storage control unit 130 stores the travel speed information sorted out by the traffic information sorting unit 110 in the traffic information storage unit 140 (step 306).

FIG. 4 is a flowchart illustrating the procedure of creating the matching table for matching the first and second map data to each other in the method of processing traffic information according to the invention. As shown in the figure, all links existing within a predetermined search range around the position of a start node of a predetermined link in the first map data stored in the first map storage unit 150 are extracted by the matching unit 170 from the second map data stored in the second map storage unit 160, and are set as candidate links to be matched to a predetermined link in the first map data (step 400).

Here, candidate links are extracted by defining a search range after converting coordinate values of the first map data stored in the first map storage unit 150 and coordinate values of the second map data stored in the second map storage unit 160 into coordinate values in an identical coordinate system. For example, the coordinate values of the first map data stored in the first map storage unit 150 can be retrieved after being converted into the coordinate values of the second map data stored in the second map storage unit 160. Further, the coordinate values of the second map data stored in the second map storage unit 160 may be retrieved after being converted into the coordinate values of the first map data stored in the first map storage unit 150. In addition, both the coordinate values of the first map data stored in the first map storage unit 150 and the coordinate values of the second map data stored in the second map storage unit 160 may be retrieved after being converted into coordinate values of a longitude and latitude coordinate system.

When the candidate links to be matched to the predetermined link of the first map data are set in step 400, the matching unit 170 determines the number of candidate links (N) (step 402). If the number of candidate links (N) is not '0', the candidate links are selected one by one (step 404), and it is determined whether the name of a link of the first map data and the name of one of the candidate links are coincident with each other (step 406). Further, it is determined whether the name of a start node of the link in the first map data and the name of a start node or end node of one of the candidate links are coincident with each other (step 408).

If the link names are not coincident with each other in step 406 or the node names are not coincident with each other in step 408, the matching unit 170 subtracts '1' from the number of candidate links (N) (step 410) and determines the candidate link of which the link name or node name is not coincident with that of the link or node in the first map data as a reserved candidate node (step 412). Then, the procedure returns to step 402 where the number of remaining candidate links is determined. If the number of candidate links (N) is not '0', the next candidate link is selected in step 404. The operations for determining whether the link names and node names are coincident with each other are performed again in steps 406 and 408, respectively.

Then, when the link names are coincident with each other in step 406 and the node names are also coincident with each other in step 408, the matching unit 170 determines the node of the second map dada, which is coincident in view of both the link name and the node name, as a matched node that is matched to a start node of the link of the first map data (step 414). That is, the start node of the link of the first map dada is determined as a matched node, which is matched to the node of second map data that has the coincident the node name in step 414.

If any candidate node that has a coincident link name and node name is not found until the number of candidate links becomes '0' in step 402, the map matching unit 170 selects a nearest reserved candidate node among the set, reserved candidate nodes and determines the selected node as a matched node (step 416). That is, the candidate node nearest from the start node of the link of the first map dada is determined as a matched node that is matched to the start node of the link of the first map dada.

When a node in the second map data that is matched to a start node of a link in the first map data is determined in such a manner, the matching unit 170 acquires configuration/location information on the link in the first map data, i.e., location information on respective nodes constituting the link, using link IDs and node IDs of the second map data (step 418), and creates a matching table using the acquired location information and stores the created matching table in the matching table storage unit 180 (step 420).

For example, the first map data stored in the first map data storage unit 150 includes a link ID, a link name, IDs of start and end nodes of a relevant link, names of the start and end nodes of the relevant link, and longitude coordinates (Lon) and latitude coordinates (Lat) of the start and end nodes, as shown in FIG. 5*a*. The second map data stored in the second map data storage unit 160 includes a link ID, a link name, IDs of start and end nodes of a relevant link, names of the start and end nodes of the relevant link, longitude coordinate (Lon) and latitude coordinate (Lat) of the start node, which are first configuration/location information, and longitude coordinate (Lon) and latitude coordinate (Lat) of the end node, which are $n^{th}$ configuration/location information, as shown in FIG. 5*b*.

For such first and second map data, the matching method of the present invention determines whether link names and node names are coincident with each other between the first and second map data. If the link names and the node names are coincident with each other therebetween, a relevant node is determined as a matched node. If the link names and the node names are not coincident with each other therebetween, the nearest node is determined as a matched node. Then, the configuration/location information of a link in the first map data, i.e., location information on respective nodes existing on the link, is retrieved, and a matching table is then created as shown in FIG. 5*c*. The created matching table is stored in the matching table storage unit 180.

FIG. 6 is a flowchart illustrating the procedure of determining the matching status of the first and second map data matched according to the method of processing traffic information according to the present invention. As illustrated in the figure, link ID and node ID of the second map data, which is matched to a link and a start node of the link in the first map data, are retrieved (step 600), and all links that can be connected to the corresponding link and allow the passage of a mobile object are extracted from the second map data (step 602). Then, among the extracted links, the matching unit 170 selects a link that has a connection angle similar to that of the link in the first map data (step 604). That is, a link that has an angle most similar to the angle from the start node to the end node of the link in the first map data is selected.

In next step 606, it is determined whether the ID of the end node of the link in the first map data is coincident with the ID of the selected node in the second map data. If it is determined that the IDs of the nodes are coincident with each other, the matching is determined as normal matching (step 608).

If it is determined in step 606 that the IDs of the nodes are not coincident with each other, the matching unit 170 determines whether the comparison has been made for all nodes existing in a range of a determined distance (step 610). For example, a distance twice as large as the distance from the start node to the end node of the link in the first map data is defined as a search distance, and it is then determined whether IDs of all nodes existing in a range of the defined search distance in the second map data have been compared with the ID of the end node of the link in the first map data.

If it is determined in step 610 that the comparison has not been made for all nodes, the matching unit 170 returns to step 602 and repeatedly performs the following operations of: extracting links, which can be connected to the corresponding node and allow the passage of a mobile object, from the second map data (step 602); selecting a link that has a connection angle similar to the angle of the link in the first map data among the extracted links (step 604); determining whether the ID of the end node and the ID of the selected node are coincident with each other (step 606); and, if the IDs of the nodes are coincident with each other, determining that the matching is normal matching (step 608).

If there is no matched node even though all the nodes existing in the range of the predetermined distance have been selected and compared in view of IDs, the matching is determined as abnormal matching (step 612).

FIG. 7 is a flowchart illustrating the procedure of displaying traffic information in the method of processing traffic information according to the invention. As illustrated in the figure, when the matching unit 170 receives map display information such as information on the current location or travel route of a mobile object (step 700), the matching unit 170 loads first map data on a certain area from the first map storage unit 150 according to the map display information (step 702).

Then, the matching unit 170 identifies links in second map data corresponding to respective links of the loaded first map data using a matching table stored in the matching table storage unit 180 (step 704), and converts each of the identified links in the second map data into an index according to Equation 1 (step 706).

Traffic information corresponding to the index, i.e., information on the travel speed of a mobile object, is retrieved from the traffic information storage unit 140 (step 708), and a color is determined according to the retrieved travel speed information (step 710). For example, color is determined according to the speed of a mobile object in such a manner that it is red when the travel speed is 0 to 20 km; orange when the travel speed is 20 to 40 km; and green when the travel speed is 40 to 60 km.

Next, arrows with the determined colors are created along the travel direction of the corresponding link in the first map data, and the created arrows are output to and displayed on the display unit 190 (step 712).

FIG. 8 is a flowchart illustrating the operation of a first embodiment in which the arrows with predetermined colors are created along the travel direction of a mobile object and inserted into the first map data in step 712 of FIG. 7. As illustrated in the figure, the matching unit 170 sets up road boundary lines 902 and 904 on right and left sides of each link 900 as depicted in FIG. 9 (step 800). Here, if there is no road width information and road boundary information in the first map data, the road boundary lines 902 and 904 are set up by calculating boundary areas using the number of lanes. Next, the traffic information is added to the displayed right and left boundary lines 902 and 904 using arrows 906 and 908 with predetermined colors according to the travel speed of the mobile object in respective travel directions (step 802).

That is, the travel speed of the mobile object in a forward direction is added to the right boundary line 902 using the arrow 906 with a predetermined color, and the travel speed of the mobile object in an opposite direction is added to the left boundary line 904 using the arrow 908 with a predetermined color.

FIG. 10 is a flowchart illustrating the operation of a second embodiment in which arrows with predetermined colors are created along the travel direction of a mobile object and inserted into the first map data in step 712 of FIG. 7. As illustrated in the figure, each link on which traffic information will be indicated is partitioned into halves (step 1000). Next, as depicted in FIG. 11, an arrow 1100 with a predetermined color according to the travel speed at which the mobile object can travel in a forward direction is inserted into one of the partitioned halves of each link (step 1002). Then, an arrow 1102 with a predetermined color according to the travel speed at which the mobile object can travel in an opposite direction is inserted into the other of the partitioned halves of each link (step 1004).

FIG. 12 is a flowchart illustrating the operation of a third embodiment in which arrows with predetermined colors are created along the travel direction of a mobile object and inserted into the first map data in step 712 of FIG. 7. As illustrated in the figure, the matching unit 170 acquires, from the first map data, coordinates (St_x, St_y) of a start point St and coordinates (Ed_x, Ed_y) of an end point Ed of a link 1300 on which traffic information is indicated as depicted in FIG. 13*a* (step 1200), determines whether the link allows two-way traffic (step 1202), and determines whether traffic information on opposite traffic is stored in the traffic information storage unit 140 (step 1204).

If it is determined in steps 1202 and 1204 that two-way traffic is allowed and traffic information on opposite traffic is stored, the coordinates (St_x, St_y) of the start point St and the coordinates (Ed_x, Ed_y) of the end point Ed of the link are set as the coordinates of start points ASt1 and AEd1 of arrows for indicating the travel speed of a mobile object (step 1206). That is, the coordinates (St_x, St_y) of the start point St of the link are set as the coordinate of a start point ASt1 of an arrow for indicating the travel speed of a mobile object in a forward direction, and the coordinates (Ed_x, Ed_y) of the end point Ed of the link is set as the coordinate of a start point AEd1 of an arrow for indicating the travel speed of a mobile object in an opposite direction.

In next step 1208, the coordinates of an end point ASt2 for creating an arrow are determined from the coordinates of the start point ASt1 of the arrow using the following Equation 2, and the coordinates of an end point AEd2 coordinate for creating an arrow are determined from the coordinates of the start point ASt1 of the arrow, using the following Equation 3:

$$ASt2_x=St_x+(Ed_x-St_x)/3$$

$$ASt2_y=St_y+(Ed_y-St_y)/3 \quad (2)$$

$$AEd2_x=St_x+(Ed_x-St_x)\cdot 2/3$$

$$AEd2_y=St_y+(Ed_y-St_y)\cdot 2/3 \quad (3)$$

Here, ASt2_x and ASt2_y, and AEd2_x and AEd2_y are the x- and y-axis coordinates of the end points ASt2 and AEd2 of the respective arrows, and St_x and St_y are the x- and y-axis coordinates of the start point of the link and Ed_x and Ed_y are the x-and y-axis coordinates of the end point of the link.

If it is determined in steps 1202 and 1204 that two-way traffic is not allowed or traffic information on opposite traffic is not stored, as depicted in FIG. 13*b*, the matching unit 170 sets the coordinates (St_x, St_y) of a start point St of a link as the coordinates of a start point ASt1 of an arrow for indicating the travel speed of a mobile object (step 1210), and determines the coordinates of an end point ASt2 of the arrow using the following Equation 4 (step 1212).

$$ASt2_x=St_x+(Ed_x-St_y)\cdot 2/3$$

$$ASt2_y=St_y+(Ed_y-St_y)\cdot 2/3 \quad (3)$$

When the coordinates of the start point and end point of the arrow for indicating traffic information have been set, the coordinates TP of an end point for creating a branch of the head of the arrow are set by adding or subtracting predetermined coordinates N to or from the set coordinates of the end point of the arrow (step 1214). That is, as depicted in FIGS. 13*a* and 13*b*, the coordinates TP of an end point for creating a branch of the head of an arrow are set by subtracting the predetermined coordinates N from the coordinates of the end point ASt2 of the arrow, and the coordinates TP of another end point for creating a branch of the head of another arrow are set by adding the predetermined coordinates N to the coordinates of the end point AEd2 of the arrow.

Each of the arrows is completed by rotating the set coordinates TP of the end point for creating the branch of the head of the arrow by a predetermined angle $\alpha$ in a counterclockwise direction (step 1216), drawing a straight line from the coordinates of the start point to those of the end point of the link with a color according to the travel speed at which a mobile object can travel on the link (step 1218), and drawing a straight line from the coordinates of the end point of the link to the rotated coordinates TP of the end point for creating the branch of the head of the arrow with the color according to the travel speed of the mobile object (step 1220).

Then, it is determined whether the display of a map is completed (step 1222). If it is determined that the display of a map is not completed, the procedure returns to step 1200 to acquire the coordinates of a start point St and the coordinates of an end point Ed of the next link. Thereafter, the operation of drawing arrows is performed iteratively, for example, to display traffic information on a link using arrows with colors according to the speed of a mobile object, as depicted in FIG. 14. If it is determined in step 1222 that the display of a map has been completed, the procedure terminates.

As described above, the present invention creates an index using remaining traffic information except travel speed information among received traffic information and stores the index together with travel speed information, so that the storage capacity of the traffic information storage unit can be reduced. Further, a matching table is created and stored, which matches first map data used by a traffic information center that broadcasts traffic information and second map data used by a navigation system, so that the navigation system utilizes the traffic information broadcast by the traffic information center, provides a user of a mobile object with traffic information on a travel route, and searches for an optimum travel route according to traffic information. In addition, the present invention performs a minimum amount of calculation of the received travel speed information on the mobile object, and then displays arrows with colors corresponding to travel speeds on a map, so that the user of the mobile object can readily recognize traffic information and the traffic information can be used more efficiently in real-time.

Meanwhile, although the present invention has been described and illustrated in connection with the specific preferred embodiments, it will be readily understood by those skilled in the art that various adaptations and changes can be made thereto without departing from the spirit and scope of the present invention defined by the appended claims. For example, although the present invention has been described by way of example as creating an index using link number information, link type information and travel direction information, it is not limited thereto. The present invention may be implemented in various ways, including a method in which an index is created using given information except travel speed information among broadcast traffic information. In addition, although the present invention has been described in connection with an example in which map data used by a traffic information center is different from map data used by a navigation system, the invention may be implemented in various ways, including a method in which the same map data are used by a traffic information center and a navigation system and received traffic information can be matched directly to the map data without using a matching table.

What is claimed is:

1. An apparatus for processing traffic information, comprising:

a receiver module for receiving the traffic information;

a traffic information sorting unit for sorting travel information from the traffic information received from the receiver module, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

an index creation unit for creating an index by combining the link type information, the link number information and the travel direction information sorted by the traffic information sorting unit;

a traffic information storage control unit for controlling storage of the index created by the index creation unit and the travel speed information sorted by the traffic information sorting unit; and a traffic information storage unit for storing the indexes and the travel speed information under the control of the traffic information storage control unit.

2. The apparatus as claimed in claim 1, wherein the index creation unit comprises:

a first multiplier for multiplying link number information by two;

a first adder for adding road type information to an output signal of the first multiplier;

a second multiplier for multiplying an output signal of the first adder by two; and a second adder for adding travel direction information to an output signal of the second multiplier.

3. An apparatus for processing traffic information, comprising:

a receiver module for receiving the traffic information;

a traffic information sorting unit for sorting travel information from the traffic information received from the receiver module, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

an index creation unit for creating an index by combining the link type information, the link number information and the travel direction information sorted by the traffic information sorting unit;

a traffic information storage control unit for controlling storage of the index created by the index creation unit and the travel speed information sorted by the traffic information sorting unit;

a traffic information storage unit for storing the index and the travel speed information under the control of the traffic information storage control unit;

a first map storage unit for storing first map data to be used by a traffic information center for broadcasting the traffic information;

a second map storage unit for storing second map data to be used by a navigation system for guiding the travel of a mobile object;

a matching unit for controlling extraction of a matching table for matching the first and second map data respectively stored in the first and second map storage units to each other, and displaying the traffic information stored in the traffic information storage unit after matching the traffic information to the second map data using the matching table;

a matching table storage unit for storing the matching table extracted by the matching unit; and a display unit for displaying the second map data and the traffic information under the control of the matching unit.

4. The apparatus as claimed in claim 3, wherein the index creation unit comprises:

a first multiplier for multiplying link number information by two;

a first adder for adding road type information to an output signal of the first multiplier;

a second multiplier for multiplying an output signal of the first adder by two; and a second adder for adding travel direction information to an output signal of the second multiplier.

5. An apparatus for processing traffic information, comprising:

a receiver module for receiving the traffic information;

a traffic information sorting unit for sorting travel information from the traffic information received from the receiver module, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

an index creation unit for creating an index by combining the link type information, the link number information and the travel direction information sorted by the traffic information sorting unit;

a traffic information storage control unit for controlling storage of the index created by the index creation unit and the travel speed information sorted by the traffic information sorting unit;

a traffic information storage unit for storing the indexes and the travel speed information under the control of the traffic information storage control unit;

a map storage unit for storing map data used by a traffic information center for broadcasting the traffic information and by a navigation system for guiding the travel of a mobile object;

a matching unit for controlling displaying the traffic information stored in the traffic information storage unit after matching the traffic information to the map data; and a display unit for displaying the map data and the traffic information under the control of the matching unit.

6. A method for processing traffic information, comprising the steps of:

receiving, by a receiver module, traffic information broadcast signals;

sorting travel information from the traffic information received from the receiver module by a traffic information sorting unit, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

creating, by an index creation unit, an index by combining the link type information, the link number information and the travel direction information from the sorted traffic information; and storing, by a traffic information storage control unit, travel speed information sorted out by the traffic information sorting unit in a traffic information storage unit, using the created index.

7. The method as claimed in claim 6, wherein the index creating step comprises the step of:

creating an index by combining link type information, travel direction information, and link number information according to the following equation 1:

$$\text{index}=\{(\text{link number information}\times 2)+\text{link type information}\}\times 2+\text{travel direction information}. \quad (1)$$

8. A method for processing traffic information, comprising the steps of:

receiving, by a receiver module, traffic information broadcast signals;

sorting travel information from the traffic information received from the receiver module by a traffic information sorting unit, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

creating, by an index creation unit, an index by combining the link type information, the link number information and the travel direction information from the sorted traffic information;

storing, by a traffic information storage control unit, travel speed information sorted out by the traffic information sorting unit in a traffic information storage unit, using the created index;

extracting links from second map data used by a navigation system, the links existing within a predetermined search range around the position of a start node of each link in first map data for use in broadcasting the traffic information, and setting the extracted links as candidate links to be matched to the link in the first map data;

extracting one node most similar to the attribute of the start node of the link in the first map data among start nodes or end nodes of the set candidate links, and determining the extracted node as a matched node for the start node of the link in the first map data;

acquiring configuration/location information on the link in the first map data, using a link ID and a node ID of the determined, matched node in the second map data, creating a matching table, and storing the created matching table in a matching table memory;

matching the traffic information stored in the traffic information storage unit to the second map data using the stored matching table; and displaying the matched second map data and traffic information on a display unit.

9. The method as claimed in claim 8, wherein the index creating step comprises the step of:

creating an index by combining link type information, travel direction information, and link number information according to the following equation 1:

$$\text{Index}=\{(\text{link number information}\times 2)+\text{link type information}\}\times 2+\text{travel direction information}. \quad (1)$$

10. The method as claimed in claim 8, wherein the candidate link setting step comprises the step of:

converting coordinate values of the first and second map data into coordinate values in an identical coordinate system, extracting, from the second map data, the links existing within the predetermined search range around the start node of each link in the first map data, and setting the extracted links as the candidate links.

11. The method as claimed in claim 10, wherein the step of converting the coordinate values of the first and second map data into the coordinate values in the identical coordinate system comprises the step of:

converting the coordinate values of the first map data into coordinate values in a coordinate system of the second map data, converting the coordinate values of the second map data into coordinate values in a coordinate system of the first map data, or converting all the coordinate values of the first and second map data into coordinate values in a longitude and latitude coordinate system.

12. The method as claimed in claim 8, wherein the step of determining the matched node comprises the steps of:

selecting the candidate links one by one, and determining whether the name of each candidate link is coincident with the name of the link in the first map data and whether the name of a start node or an end node of the candidate link is coincident with the name of the start node of the link in the first map data;

if it is determined that the names of both the link and node are coincident with those of the start node of the link in the first map data, determining the node with the coincident node name as the matched node for the start node of the link in the first map data; and if it is determined that there is no candidate link with identical link and node names, determining, among candidate nodes, a node nearest to the start node of the link in the first map data as a matched node.

13. The method as claimed in claim 8, after the step of determining the matched node, further comprising the step of:

determining as a normal matching if an ID (Identification) of the end node of the link of the first map data corresponds to an ID of the node selected by the second map data, and determining as an abnormal matching if a node corresponding to an ID of the end node of the link of the first map data is not available in the second map data.

14. The method as claimed in claim 13, wherein the step of determining whether the matched node is normal matching or abnormal matching comprises the steps of:

extracting a link ID and a node ID of the node in the second map data, which has been matched to the start node of the link in the first map data, and extracting links connected to the corresponding node in the second map data;

selecting one link, which has a connection angle most similar to the angle from the start node to the end node of the link in the first map data, from the extracted links, and choosing nodes of the selected link sequentially to determine whether an ID of a chosen node is coincident with an ID of the end node of the link in the first map data;

if it is determined that there is a node with a coincident ID, determining the matching as the normal matching; and if it is determined that there is no node with a coincident ID, determining the matching as the abnormal matching.

15. The method as claimed in claim 14, wherein the abnormal matching determining step comprises the step of:

determining the matching as abnormal matching, if there is no node with a coincident ID within a distance twice as large as the distance from the start node to the end node of the link in the first map data.

16. The method as claimed in claim 8, wherein the traffic information matching step comprises the steps of:

searching for a link in the first map data, which is matched to each link in the second map data, using the matching table stored in the matching table storage unit, creating an index by substituting link number information, link type information and travel direction information on the searched link in the first map data into the following equation 1, searching the traffic information stored in the traffic information storage unit using the created index, and performing matching to the corresponding link of the second map data:

$$\text{Index}=\{(\text{link number information}\times 2)+\text{link type information}\}\times 2+\text{travel direction information}. \quad (1)$$

17. The method as claimed in claim 8, wherein the traffic information displaying step comprises the steps of:

setting road boundary lines on right and left sides of each link in the first map data, and adding traffic information on the travel of a mobile object in a forward or opposite direction to the set right and left boundaries using arrows with predetermined colors according to the travel speed of the mobile object.

18. The method as claimed in claim 17, wherein the boundary lines of the link are set by using road width information and road boundary information included in the first map data, or by calculating boundary areas using the number of lanes.

19. The method as claimed in claim 8, wherein the traffic information displaying step comprises the step of:

partitioning each link into halves, adding traffic information to one of the halves of the partitioned link using an arrow with a predetermined color according to the travel speed at which a mobile object can travel in a forward direction, and adding traffic information to the other of the halves of the partitioned link using an arrow in a predetermined color according to the travel speed at which a mobile object can travel in an opposite direction.

20. The method as claimed in claim 8, wherein the traffic information displaying step comprises the steps of:

setting coordinates of a start point and end point of an arrow for indicating the traffic information at each link;

setting coordinates of a position at a predetermined distance from the set coordinates of the end point of the arrow in a direction toward the coordinates of the start point of the arrow, as coordinates of an end point of a branch of the head of the arrow;

rotating the set coordinates of the end point of the arrow branch by a predetermined angle; and adding the arrow by drawing straight lines, from the set coordinates of the start point of the arrow to the set coordinates of the end point of the arrow, and from the coordinates of the rotated end point of the arrow branch to the coordinates of the end point of the arrow, with predetermined colors according to the travel speed of the traffic information.

21. The method as claimed in claim 20, wherein the step of setting the coordinates of the start point and end point of the arrow comprises the steps of:

acquiring the coordinates of the start point and end point of the link;

determining whether the link allows two-way traffic and whether traffic information on travel in an opposite direction is stored in the traffic information storage unit;

if it is determined that the link allows two-way traffic and the traffic information on travel in the opposite direction is stored, setting the coordinates of the start point and end point of the link as coordinates of start points of two arrows, respectively, and setting coordinates of positions on the link at a predetermined distance from the set coordinates of the start points of the two arrows as coordinates of end points of the arrows, respectively; and if it is determined that the link does not allow two-way traffic or traffic information on travel in the opposite direction is not stored, setting the coordinates of the start point of the link as coordinates of a start point of an arrow, and setting coordinates of a position on the link at a predetermined distance from the coordinates of the start point of the arrow as coordinates of an end point of the arrow.

22. The method as claimed in claim 21, wherein if it is determined that the link allows two-way traffic and the traffic information on the travel in the opposite direction is stored, the coordinates of the end points of the arrows are set using the following equations 2 and 3:

$$ASt2_x=St_x+(Ed_x-St_x)/3$$

$$ASt2_y=St_y+(Ed_y-St_y)/3 \quad (2)$$

$$AEd2_x=St_x+(Ed_x-St_x)\cdot 2/3$$

$$AEd2_y=St_y+(Ed_y-St_y)\cdot 2/3 \quad (3)$$

where ASt2_x and ASt2_y, and AEd2_x and AEd2_y are x- and y-axis coordinates of the end points of the respective arrows, St_x and St_y are x- and y-axis coordinates of the start point of the link, and Ed_x and Ed_y are the x- and y-axis coordinates of the end point of the link.

23. The method as claimed in claim 21, wherein if it is determined that the link does not allow two-way traffic or the traffic information on the travel in the opposite direction is not stored, the coordinates of the end point of the arrow is set using the following equation 4:

$$Ast2_x=St_x+(Ed_x-St_x)\cdot 2/3$$

$$Ast2_y=St_y+(Ed_y-St_y)\cdot 2/3 \quad (4)$$

where ASt2_x and ASt2_y are x- and y-axis coordinates of the end point of the arrow, St_x and St_y are x- and y-axis coordinates of the start point of the link and Ed_x and Ed_y are x- and y-axis coordinates of the end point of the link.

24. A method for processing traffic information, comprising the steps of:

receiving, by a receiver module, traffic information broadcast signals;

sorting travel information from the traffic information received from the receiver module by a traffic information sorting unit, wherein the travel information comprises:

link type information for use in identifying an expressway or a general road;

link number information for notifying a link related to the traffic information;

travel direction information for use in identifying whether the traffic information is related to travel in a forward direction or an opposite direction; and travel speed information on a mobile object at a relevant link;

creating, by an index creation unit, an index by combining the link type information, the link number information and the travel direction information from the sorted traffic information:

storing, by a traffic information storage control unit, travel speed information sorted out by the traffic information sorting unit in a traffic information storage unit, using the created index;

matching the traffic information stored in the traffic information storage unit to map data; and displaying the matched map data and traffic information on a display unit.

* * * * *